US011420658B2

(12) United States Patent
Bieker et al.

(10) Patent No.: US 11,420,658 B2
(45) Date of Patent: Aug. 23, 2022

(54) RUNNING GEAR WITH A SINGLE PAIR OF INDEPENDENT LEFT AND RIGHT WHEELS AND LATERAL STOP MEANS, AND ASSOCIATED LOW FLOOR RAIL VEHICLE

(71) Applicant: Bombardier Transportation GmbH, Berlin (DE)

(72) Inventors: Guido Bieker, Kirchhundem (DE); Reinhard Pieper, Kirchhundem (DE)

(73) Assignee: Bombardier Transportation GmbH, Berlin (DE)

( * ) Notice: Subject to any disclaimer, the term of this patent is extended or adjusted under 35 U.S.C. 154(b) by 370 days.

(21) Appl. No.: 16/689,482

(22) Filed: Nov. 20, 2019

(65) Prior Publication Data

US 2020/0164902 A1 May 28, 2020

(30) Foreign Application Priority Data

Nov. 22, 2018 (GB) ..... 1819025

(51) Int. Cl.

| | |
|---|---|
| ***B61F 5/24*** | (2006.01) |
| ***B61F 1/14*** | (2006.01) |
| ***B61F 3/00*** | (2006.01) |

(52) U.S. Cl.

CPC ..... *B61F 5/24* (2013.01); *B61F 1/14* (2013.01); *B61F 3/00* (2013.01)

(58) Field of Classification Search

CPC ..... B61F 1/14; B61F 3/00; B61F 3/12; B61F 5/02; B61F 5/04; B61F 5/24

See application file for complete search history.

(56) References Cited

U.S. PATENT DOCUMENTS 10,315,670 B2 6/2019 Sanchez et al.

FOREIGN PATENT DOCUMENTS

| | | | | |
|---|---|---|---|---|
| CN | 205022599 U | | 2/2016 | |
| DE | 4419362 A1 | | 12/1995 | |
| EP | 0655378 A1 | | 5/1995 | |
| EP | 3159237 A1 | | 4/2017 | |
| GB | 791677 | | 3/1958 | |
| KR | 101498450 B1 | | 3/2015 | |
| WO | 2017202221 A1 | * | 11/2017 | ..... B61F 5/04 |

* cited by examiner

*Primary Examiner* — Robert J McCarry, Jr.
(74) *Attorney, Agent, or Firm* — The Webb Law Firm

(57) ABSTRACT

A running gear for a low floor rail vehicle includes a frame, a single pair of independent left and right wheels, and a single pair of left and right rotation bearings attached to the frame that allow the left and right wheels to independently spin about a left and right spin axis, respectively. The running gear further includes a secondary suspension resting on the frame for supporting a vehicle body of the rail vehicle and lateral stop means fixed to the frame for laterally guiding the vehicle body of the rail vehicle. The lateral stop means includes a left and a right contact face facing a left and a right, respectively, transverse direction parallel to the transverse reference axis. The left and right contact faces are located between the left and right wheels.

18 Claims, 3 Drawing Sheets

RUNNING GEAR WITH A SINGLE PAIR OF INDEPENDENT LEFT AND RIGHT WHEELS AND LATERAL STOP MEANS, AND ASSOCIATED LOW FLOOR RAIL VEHICLE

CROSS-REFERENCE TO RELATED APPLICATION

This application claims priority to United Kingdom Patent Application No. 1819025.6 filed Nov. 22, 2018, the disclosure of which is hereby incorporated by reference in its entirety.

BACKGROUND OF THE INVENTION

Field of the Invention

The present invention relates to a running gear with a single pair of independent left and right wheels and to a rail vehicle provided with such a running gear.

Description of Related Art

A rail vehicle provided with running gears having a single pair of independent left and right wheels, i.e. wheels that can rotate independently from one another, is known from KR101498450B1. Each running gear has a pair or left and right rotation bearings for guiding a pair of left and right idle wheels, which are located between the left and right rotation bearings. The running gear is provided with a rectangular frame with two longitudinal beams extending each above one of the rotation bearings and two transverse beams that extend in a common horizontal plane located below the spin axes of the wheels, respectively in front and behind the two wheels. To support the load of the car body, a vertical primary suspension is installed between the rotation bearings and the bogie frame, and a vertical secondary suspension is installed between the bogie frame and the vehicle body. The bogie frame is connected to the car body by a pair of longitudinal connecting rods, which form a vertical deformable parallelogram, to transmit longitudinal forces while allowing vertical relative motion between the car body and the running gear. Vertical, longitudinal and transverse dampers are provided between the frame and the car body to absorb kinetic energy and dampen the relative motion between the car body and the frame of the running gear. The longitudinal dampers are connected to the longitudinal beams of the running gear frame, i.e. at a substantial distance from the longitudinal vertical median plane of the running gear, whereas the transverse dampers are located on the transverse beams of the frame, i.e. at a substantial distance from the vertical transverse plane containing the spin axes of the left and right wheels. As a result, the longitudinal and lateral dampers are operational to counter any steering movement of the running gear frame relative to the car body.

Another rail vehicle provided with running gears having a single pair of left and right wheels is known from EP 0 655 378. Here, the wheels are mounted on a common wheel axle, i.e. they are not independent since they rotate together with the wheel axle. The resulting dynamic behavior of the running gear on the railway track, in particular the wheelset hunting, is therefore different from a running gear with independent wheels. The wheel axle is journaled in a pair of rotation bearings, which are connected to a running gear frame by means of a primary suspension. The frame is mounted relative to the vehicle body of the rail vehicle so as to pivot about a vertical axis. The linkage between the vehicle body and the frame includes resilient elements for producing a return force against yaw motion of the running gear, as well as an actuator controlled as to act in opposition to the return force of the resilient elements. Movements of the frame in the transverse direction are limited by abutment stops, which are arranged on guide brackets fixed to the car body laterally on each side of the running gear frame, which is only possible because the width of the vehicle body is substantially greater than the width of the running gear. The space between the wheels is occupied by the wheel axle and a motor unit. Hence, the underbody of the vehicle body is located substantially above the wheels and the running gear appears to be inappropriate for a low floor vehicle.

SUMMARY OF THE INVENTION

The invention aims to provide a light running gear with a compact layout for a low floor vehicle, with an effective transmission of the transverse motion of the running gear to the car body that does not affect the steering of the running gear.

According to a first aspect of the invention, there is provided a running gear for a low floor rail vehicle, comprising:

- a frame defining a transverse reference axis and a vertical transverse reference plane containing the transverse reference axis, a vertical longitudinal median plane perpendicular to the transverse reference axis and a horizontal reference plane containing the transverse reference axis;
- a single pair of independent left and right wheels, located on a left, respectively right side of the vertical longitudinal median plane, equidistant from the vertical longitudinal median plane;
- a single pair of left and right rotation bearings attached to the frame, allowing the left and right wheels, to independently spin about a left, respectively right spin axis aligned with the transverse reference axis;
- a secondary suspension resting on the frame for supporting a vehicle body of the rail vehicle; and
- lateral stop means fixed to the frame for laterally guiding the vehicle body of the rail vehicle, the lateral stop means comprising a left and a right contact face facing a left, respectively right, transverse direction parallel to the transverse reference axis, wherein the left and right contact faces are located between the left and right wheels.

The lateral stop means are effective to laterally push the car body to follow the curves of the railway track.

The central location of the transverse stop means between the wheels, takes advantage of the comparatively large space available at this location, which allows to properly size the lateral stop means so as to absorb peak forces in the transverse direction. The stop means are close to the intersection between the transverse reference plane, longitudinal vertical reference plane and horizontal reference plane, which is virtual centre of rotation of the running gear relative to the vehicle body.

According to a preferred embodiment, the vertical transverse reference plane crosses the left and right contact faces. Because they are located in the vertical transverse reference plane, the lateral stop means do not substantially interfere with the relative yaw motion between the running gear frame and the car body about a vertical axis at the intersection between the vertical transverse axis and the vertical longitudinal median plane of the frame.

In practice, at least part of the left and right contact faces is located below the horizontal reference plane, and, preferably, the left and right contact faces are entirely located below the horizontal reference plane. Because they occupy a position that is essentially between the wheels and below the spin axes of the wheels, the lateral stop means do not negatively impact the layout of the low floor and of the underlying structure of the car body, which can freely extend, if necessary, in the room available between the wheels directly above the lateral stop means, e.g. down to the horizontal reference plane of the running gear frame and potentially below.

Preferably, the left and right contact faces are equidistant from the vertical longitudinal median plane.

In a preferred embodiment, the left and right contact faces are at least partially planar, with a planar zone parallel to the vertical longitudinal median plane.

In an embodiment, the contact face of the left lateral stop and the contact face of the right lateral stop face each other. In an alternative embodiment, the contact face of the left lateral stop and the contact face of the right lateral stop face away from one another.

The lateral stop means may comprise two independent stops, one for each of the left and right contact faces. Alternatively, the left and right contact faces are fixed relative to one another, and belong to a single stop assembly, to achieve a simpler and more compact layout.

Preferably, the lateral stop means comprise a set of one or more elastomeric bodies for connecting the left and right contact faces to the frame and for allowing limited movement of the left and right contact faces relative to the frame parallel to the transverse reference axis.

In a preferred embodiment, the frame is integral with the pair of left and right rotation bearings. A limited primary suspension stage can be provided within the rotation bearing itself, between a fixed bearing race of the rotation bearing and the rotation bearing or between a rotating bearing race of the rotation bearing and the wheel hub or wheel axle. Alternatively, the wheel itself may provide a limited primary suspension.

In an embodiment, the frame includes a pair of left and right longitudinal beams which support each a respective one of the left and right rotation bearings, a pair of front and rear transverse beams, each extending between respective ends of the left and right longitudinal beams on opposite sides of the vertical transverse reference plane. The front and rear transverse beams are located below the horizontal reference plane of the frame to avoid interference with the car body. Preferably, at least one longitudinal support beam extending between the front and rear transverse beam, wherein at least one of the left and right contact faces is supported by the longitudinal support beam. Most preferably, the longitudinal support beam supports the lateral stop means. Alternatively, the longitudinal support beam supports one of the left and right lateral stops and a further longitudinal support beam supports the other one of the left and right lateral stops.

In practice, the suspension comprises a set of left and right vertical suspension springs, preferably located each above a respective one of the left and right rotation bearings. The vertical suspension springs may comprise or consist of air bellows, which do not provide transverse or longitudinal suspension. Alternatively, they may comprise or consist of helicoidal springs or so-called helicoil springs, which provide a substantial suspension effect in the horizontal directions within a compact layout.

Another aspect of the invention relates to a low floor rail vehicle comprising a vehicle body supported by a set of one or more running gears, including at least a first running gear as described hereinbefore, wherein an underbody of the vehicle body is provided with counter stop means comprising at least a first pair of lateral contact faces each facing a respective one of the left and right contact faces of stop means of the first running gear. In particular, the low floor rail vehicle can be a light rail vehicle for urban transport, in particular for tram, fast tram or light rail transit.

In a preferred embodiment, the left and right contact faces of the running gear are located between the lateral contact faces of the vehicle body. In an alternative embodiment, the lateral contact faces of the vehicle body are located between the left and right contact faces of the running gear.

Preferably, the vehicle body rests directly on the secondary suspension of the first running gear.

In practice, the set of one or more running gears preferably includes at least a second running gear, wherein the vehicle body is provided with at least a second pair of lateral contact faces each facing a respective one of the left and right contact faces of the second running gear. The first and second running gears are preferably located at opposite ends of the vehicle body, i.e. closer to a respective one of the opposite ends than to a median vertical transverse plane of the vehicle body.

In an embodiment, the set of one or more running gears includes a pair of additional running gears, each with a single pair of independent left and right wheels, wherein each of the additional running gears is proximate a respective one of the first and second running gears, and preferably linked to the respective one of the first and second running gears. The linkage between each of the first and second running gears and the associated additional running gear may be a steering linkage, i.e. a linkage that transfers forces from one running gear frame to the other whenever a relative motion including a rotation about a vertical axis occurs between one the two associated running gears and the vehicle body.

The additional running gears can be similar to the first and second running gears, i.e. with lateral stop means, or they can be without lateral stop means.

Preferably, the underbody extends partially in a space between the pair of left and right wheels of the first running gear, below a horizontal plane tangential to an upper end of the left and right wheels of the first running gear, and preferably below the horizontal reference plane of the frame of the first running gear. Hence, the space made available by the layout of the first and second running gears is advantageously used for lowering the underbody of the vehicle body, and the interior floor of the passenger space within the vehicle body.

According to another aspect of the invention, there is provided a lateral buffer system for a rail vehicle comprising two subassemblies consisting of a vehicle body and a running gear, the buffer system comprising first and second stop devices, one of the first and second stop devices comprising lateral stop means for attachment to the running gear and the other one of the first and second stop devices comprising lateral counter-stop means for attachment to the vehicle body so as to limit the relative movement between the vehicle body and the running gear in a transverse direction of the rail vehicle. The first lateral stop device comprises a fixed support, a movable carrier provided with a pair of opposite contact faces and movable relative to the fixed support in two opposite directions parallel to a reference axis of the fixed support, and a set of one or more elastomeric bodies for resiliently connecting the movable carrier to the fixed support for allowing limited movement of the movable carrier relative to the fixed support parallel to reference axis on either side of a reference position of the movable carrier relative to the fixed support, and the second lateral stop device comprises corresponding contact faces each facing one of the contact faces of the first lateral stop device at a distance thereof. Hence, the same elastomeric bodies are used for resiliently absorbing shocks in the two opposite directions of movement of the movable carrier. Preferably at least one pair of elastic buffer bodies is arranged between the movable carrier and the fixed support so as not to interfere with the limited movement of the movable carrier relative to the fixed support parallel to the reference axis on either side of the reference position below a predetermined amplitude threshold and so as to resiliently counteract further movement of the movable carrier relative to the fixed support away from the reference position beyond the predetermined amplitude threshold, each in a respective one of the two opposite directions.

The fixed support is preferably formed as a tubular housing through which the movable carrier extends, with its contact faces protruding from the ends of the tubular housing.

BRIEF DESCRIPTION OF THE FIGURES

Other advantages and features of the invention will then become more clearly apparent from the following description of a specific embodiment of the invention given as non-restrictive examples only and represented in the accompanying drawings in which.

Corresponding reference numerals refer to the same or corresponding parts in each of the figures.

DETAILED DESCRIPTION OF PREFERRED EMBODIMENTS

Figure 1:
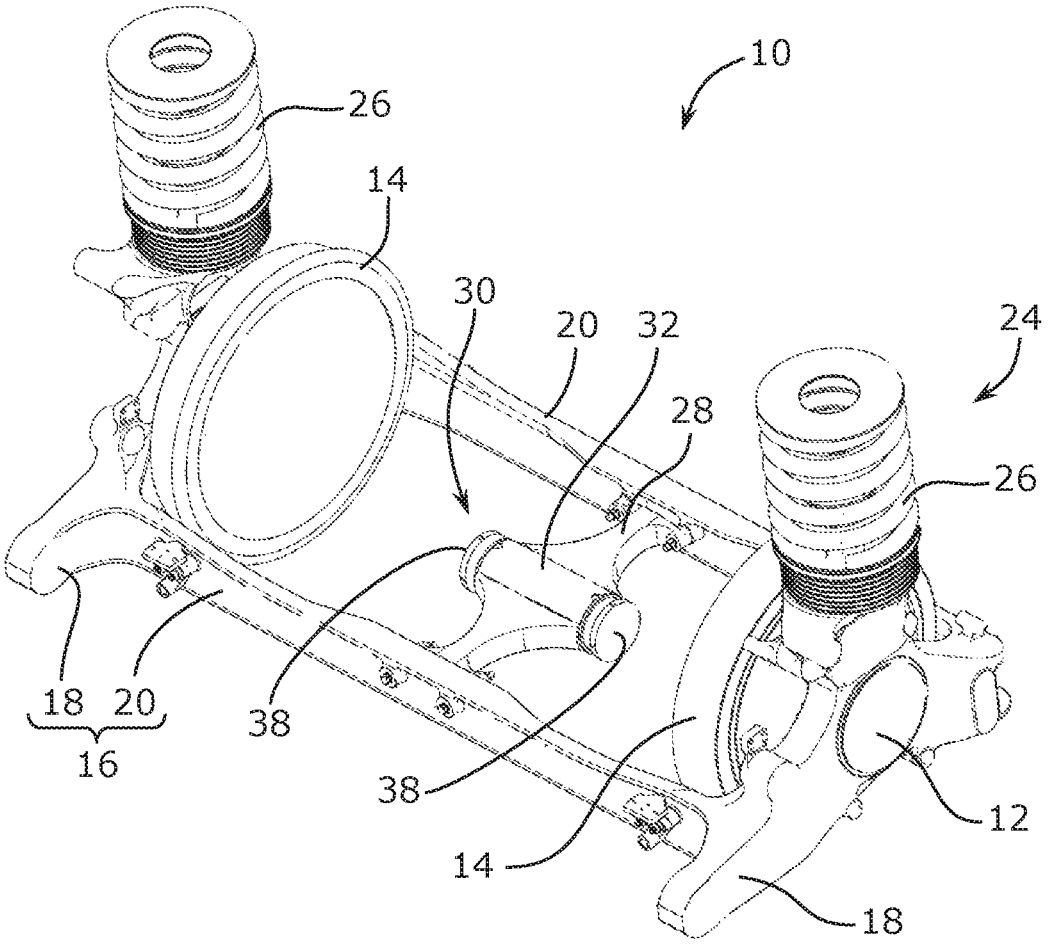
FIG. 1 is an isometric view of a running gear according to an embodiment of the invention.

With reference to FIG. 1, a running gear 10 for a rail vehicle has a pair or left and right rotation bearings 12 for guiding a pair of independent left and right idle wheels 14, which are located between the left and right rotation bearings 12. The wheels 14 are independent wheels in the sense that they do not share a common wheel axle and can spin about their respective spin axes 100L, 100R independently from one another. The running gear 10 is provided with a rectangular frame 16, comprised of two longitudinal beams 18, each integrally formed with a respective one of the left and right rotation bearings 12, and two front and rear transverse beams 20 that extend, between the two front ends, respectively the two rear ends, of the longitudinal beams 18, so that the wheels 14 viewed from above are contained within the rectangular frame 16.

Figure 2:
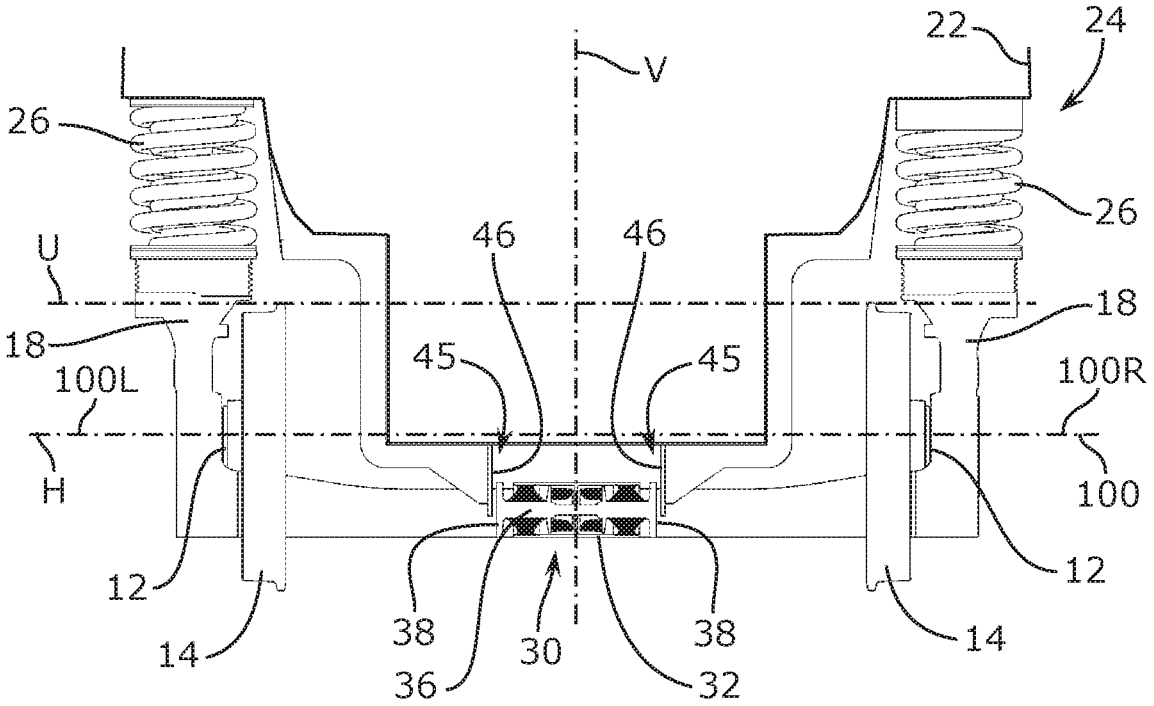
FIG. 2 is a schematic cross-sectional view of the running gear of FIG. 1 and of a corresponding part of an underbody of a rail vehicle according to the invention.

To support the load of a vehicle body 22 of the rail vehicle, a vertical secondary suspension 24 is installed directly between the bogie frame 16 and the vehicle body 22, as schematically shown in FIG. 2. In this embodiment, the vertical secondary suspension 24 comprises a helicoidal spring 26 directly above each of the two rotation bearings 12 or a set of coaxial springs in series or in parallel. As an alternative, a set of two separate parallel vertical springs could be provided at the longitudinal ends of each of the two longitudinal beams 18.

When the running gear 12 is in a standard operational position, i.e. a stationary position on a straight railway track, the frame 16 defines a transverse reference axis 100, which is aligned with the spin axes 100L, 100R of the left and right wheels 14, a vertical transverse reference plane T (i.e. the section plane of FIGS. 2 and 3) containing the transverse reference axis 100, a vertical longitudinal median plane V perpendicular to the transverse reference axis 100 and a horizontal reference plane H containing the transverse reference axis 100. As illustrated in FIGS. 2 and 4, the independent left and right wheels 14 are equidistant from the vertical longitudinal median plane V on a left, respectively right side of the vertical longitudinal median plane V. The transverse beams 18 are located on opposite sides of the vertical transverse reference plane T, at least partially below the horizontal reference plane H.

The frame 16 is further provided with a median longitudinal support beam 28 which is cut by the vertical longitudinal median plane V. The longitudinal support beam supports lateral stop means 30 for laterally guiding the vehicle body 22 of the rail vehicle, which are illustrated in detail in FIGS. 2 to 4. The lateral stop means 30 are located between the left and right wheels 14 and comprise a fixed support formed by a cylindrical housing 32 aligned with a direction parallel to the transverse reference axis 100, but at a distance below the transverse reference axis 100. The housing 32 is provided with an inner partition wall 34, which extends in the vertical longitudinal median plane V. A transverse rod 36 extends through a hole in the inner partition wall 34 and through the housing 32 so as to protrude from both ends of the housing 32. The ends of the transverse rod 36 form a left and a right planar contact face 38 perpendicular to the transverse reference axis 100. The left and right contact faces 38 are located between the wheels 14, at least partially below the horizontal reference plane H, and face away from one another towards a left, respectively right, transverse direction parallel to the transverse reference axis 100. The housing 32, the rod 36 and its left and right contact faces 38 are cut by the vertical transverse reference plane of the frame 18. The left and right contact faces 38 are equidistant from the vertical longitudinal median plane V.

Figure 3:
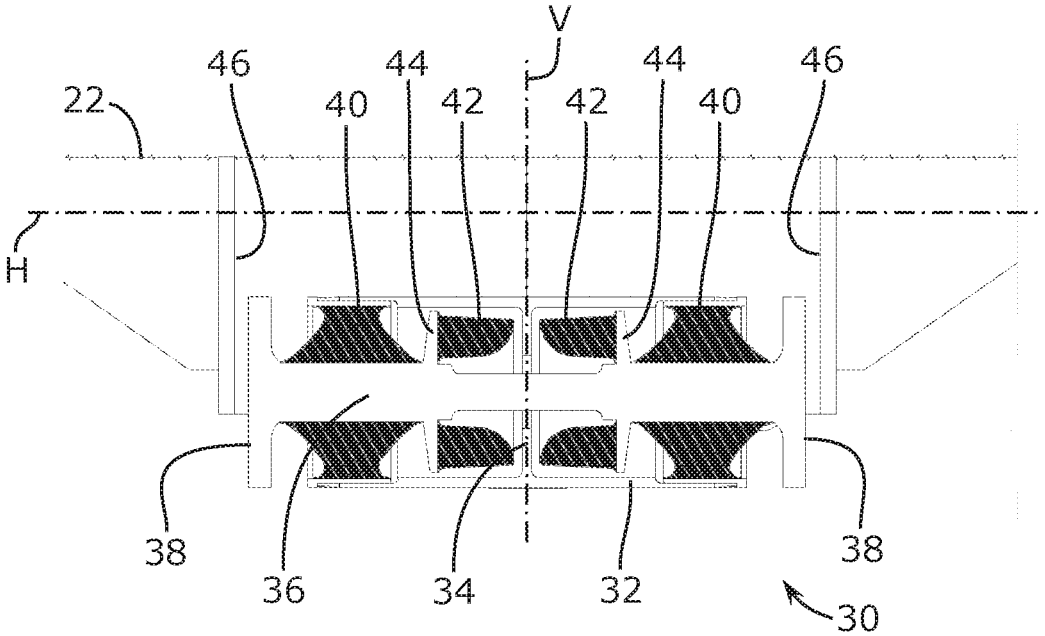
FIG. 3 is detail of FIG. 2.
Figure 4:
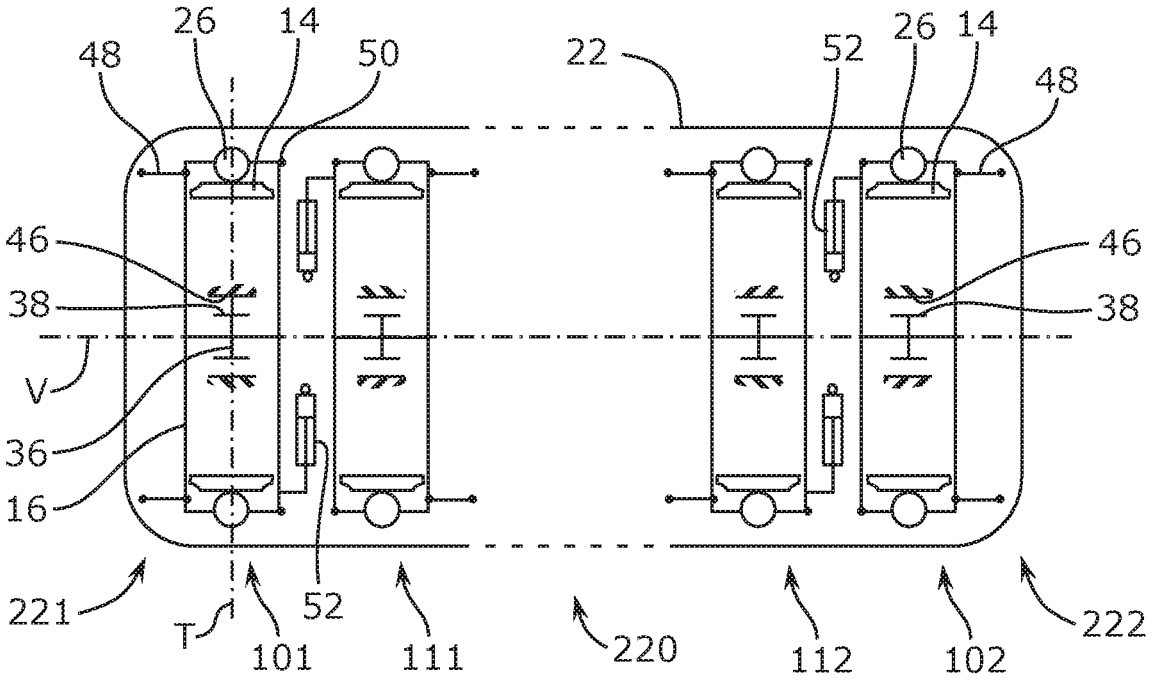
FIG. 4, illustrates a rail vehicle according to an embodiment of the invention, provided with a set of running gears, some of which are similar to the running gear of FIG. 1.

As illustrated in FIG. 3, the lateral stop means 30 comprise a set of elastomeric bodies for connecting the transverse rod 36 with the housing 32, namely a set of relatively deformable annular elastomeric bodies 40 vulcanised to a cylindric portion of the rod 36 and a cylindric inner face of the housing 32, and a set of stiffer elastomeric stops 42 interposed between an associated flange 44 provided on the rod 36 and the intermediate partition wall 34 of the housing 32. The elastomeric stops 42 are attached to the associated flange 44 of the rod 36 and face the partition wall 34 at a distance thereof.

The underbody of the vehicle body 22 is provided with counter stop means 45 formed by a pair of lateral contact faces 46, each facing at a distance a respective one of the left and right contact faces 38 of the lateral stop means 30 of the running gear 10.

The running gear of the invention is particularly suitable for a low floor rail vehicle 220 as illustrated in FIG. 4, comprising a vehicle body 22 supported by one or more running gears, including at least a first running gear 101 as described above at a first end 221 of the vehicle body, and preferably a second running gear 102 as described above at a second end 222 of the rail vehicle 22, so that the lateral motion of the vehicle body 22 can be controlled at both ends 221, 222 of the vehicle body.

As illustrated schematically in FIG. 2, the vehicle body 22 has an underbody that extends partially in a space between the pair of left and right wheels 14 of the first running gear 101, below a horizontal plane U tangential to an upper end of the left and right wheels 14 of the first running gear 101, and preferably below the horizontal reference plane H of the frame 14 of the first running gear 101. Similar considerations apply to the second running gear 102. The underbody is provided with a first pair of lateral contact faces 46 each facing a respective one of the left and right contact faces 38 of the first running gear 101, and with a second pair of lateral contact faces 46 each facing a respective one of the left and right contact faces 38 of the second running gear 102. The frame 16 of each running gear 101, 102 is connected to the vehicle body 22 by longitudinal connecting rods 48, vertical dampers 50 and transverse dampers 52, as is well known in the art.

The low floor passenger rail vehicle 220 may further comprise a pair of additional running gears 111, 112, each with a single pair of independent left and right wheels 114, for supporting the vehicle body, wherein each of the additional running gears is proximate a respective one of the first and second running gears 101, 102. The additional running gear 111, 112 may also be provided with lateral stop means, or, as depicted in FIG. 5, be without lateral stop means.

As will be readily understood, the lateral stop means 30 constitute with counter stop means 45 a lateral buffer system for limiting relative transverse movement between the vehicle body 20 and the running gear 10. A limited relative transverse motion between the running gear frame 16 and the vehicle body 22 with an amplitude less than the initial distance between the associated contact faces 38, 46 will have no effect on the lateral stop means 30. In such a case, the transverse forces are integrally transferred by the helicoidal springs 26 and the transverse damper 52 of the secondary suspension. As the amplitude of the transverse motion increases, a contact will be established between one of the contact faces 46 of the vehicle body and the respective contact face 38 of the lateral stop means 30. The contact force in the transverse direction will result in shear deformation of the annular elastomeric bodies 40 and a transmission of the applied force to the housing 32 with a dynamic damping of the higher frequency components. A higher contact force between the contact faces 46, 38 in the transverse direction will allow one of the stiffer elastomeric stops 42 to contact the partition wall 34 to limit the relative motion between the rod 36 and the housing 32, and hence between the frame 12 of the running gear 10, 101, 102 and the vehicle body 22.

Figure 5:
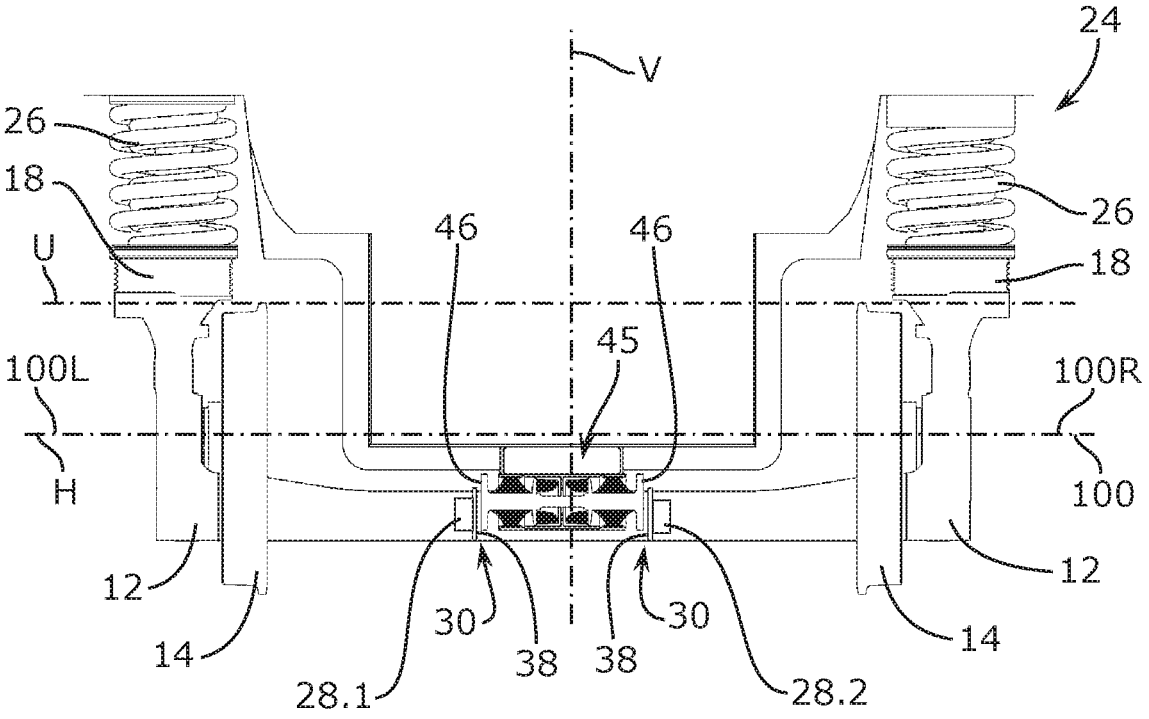
FIG. 5 illustrates a schematic cross-sectional view of the running gear and its interaction with a corresponding part of an underbody of a rail vehicle according to an alternative embodiment of the invention.

As a variant, illustrated in FIG. 5, the lateral stop means 30 on the frame 16 of the running gear 10 can be formed by two rigid contact faces 38 each formed on a dedicated intermediate longitudinal beam 28.1, 28.2 or the frame 16, whereas the counter stop means 45 includes a set of two contact faces 46 fixed to a rod 36 received in a housing 32 similar to the housing of the first embodiment.

As another variant, both the lateral stop means 30 and the counter stop means 45 can be provided with elastomeric bodies.

The housing 32 is not necessarily cylindrical. The stop faces 38 are preferably planar or convex.

The invention claimed is:

1. A running gear for a low floor rail vehicle, the running gear frame comprising:

a frame defining a transverse reference axis and a vertical transverse reference plane containing the transverse reference axis, a vertical longitudinal median plane perpendicular to the transverse reference axis and a horizontal reference plane containing the transverse reference axis;

a single pair of independent left and right wheels, located on a left and a right side, respectively, of the vertical longitudinal median plane and equidistant from the vertical longitudinal median plane;

a single pair of left and right rotation bearings attached to the frame, allowing the left and right wheels to independently spin about a left and a right spin axis, respectively, aligned with the transverse reference axis;

a secondary suspension resting on the frame for supporting a vehicle body of the rail vehicle; and a lateral stop means fixed to the frame for laterally guiding the vehicle body of the rail vehicle, the lateral stop means comprising a left and a right contact face facing a left and a right transverse direction, respectively, parallel to the transverse reference axis, wherein the left and right contact faces are located between the left and right wheels, wherein the frame includes a pair of left and right longitudinal beams which each support a respective one of the left and right rotation bearings, a pair of front and rear transverse beams, each extending between respective ends of the left and right longitudinal beams on opposite sides of the vertical transverse reference plane, and at least one longitudinal support beam extending between the front and rear transverse beam, and wherein at least one of the left and right contact faces is supported by the longitudinal support beam.

2. The running gear of claim 1, wherein the vertical transverse reference plane crosses the left and right contact faces.

3. The running gear of claim 1, wherein at least part of the left and right contact faces is located below the horizontal reference plane.

4. The running gear of claim 1, wherein the left and right contact faces are equidistant from the vertical longitudinal median plane.

5. The running gear of claim 1, wherein the left and right contact faces are at least partially planar, with a planar zone parallel to the vertical longitudinal median plane.

6. The running gear of claim 1, wherein the left and right contact faces are fixed relative to one another.

7. The running gear of claim 1, wherein the lateral stop means comprise a set of one or more elastomeric bodies for connecting the left and right contact faces to the frame and for allowing limited movement of the left and right contact faces relative to the frame parallel to the transverse reference axis.

8. The running gear of claim 1, wherein the frame is integral with the pair of left and right rotation bearings.

9. The running gear of claim 1, wherein the longitudinal support beam supports the lateral stop means.

10. The running gear of claim 1, wherein the suspension comprises a set of left and right vertical suspension springs each located above a respective one of the left and right rotation bearings.

11. A low floor rail vehicle comprising:

a vehicle body supported by a set of one or more running gears, including at least a first running gear according to claim 1, wherein an underbody of the vehicle body is provided with counter stop means comprising at least a first pair of lateral contact faces each facing a respective one of the left and right contact faces of stop means of the first running gear.

12. The low floor rail vehicle of claim 11, wherein the vehicle body rests directly on the secondary suspension of the first running gear.

13. The low floor rail vehicle of claim 11, wherein the set of one or more running gears includes at least a second running gear according to claim 1, wherein the vehicle body is provided with at least a second pair of lateral contact faces each facing a respective one of the left and right contact faces of the second running gear.

14. The low floor rail vehicle of claim 13, wherein the set of one or more running gears includes a pair of additional running gears, each with a single pair of independent left and right wheels, wherein each of the additional running gears is proximate a respective one of the first and second running gears, and preferably linked to the respective one of the first and second running gears.

15. The low floor rail vehicle of claim 11, wherein the underbody extends partially in a space between the pair of left and right wheels of the first running gear, below a horizontal plane tangential to an upper end of the left and right wheels of the first running gear, and below the horizontal reference plane of the frame of the first running gear.

16. A lateral buffer system for a rail vehicle having two subassemblies including a vehicle body and a running gear, the buffer system comprising:

a first stop device and a second stop device, one of the first and second stop devices comprising lateral stop means for attachment to the running gear and the other one of the first and second stop devices comprising lateral counter-stop means for attachment to the vehicle body so as to limit the relative movement between the vehicle body and the running gear in a transverse direction of the rail vehicle, wherein the first lateral stop device comprises:

a fixed support, a movable carrier provided with a pair of opposite contact faces and movable relative to the fixed support in two opposite directions parallel to a reference axis of the fixed support, and a set of one or more elastomeric bodies for resiliently connecting the movable carrier to the fixed support for allowing limited movement of the movable carrier relative to the fixed support parallel to reference axis on either side of a reference position of the movable carrier relative to the fixed support, and wherein the second lateral stop device comprises corresponding contact faces each facing one of the contact faces of the first lateral stop device at a distance thereof, and wherein the fixed support is formed as a tubular housing through which the movable carrier extends, and the pair of opposite contact faces of the movable carrier protrude from the ends of the tubular housing.

17. The lateral buffer system of claim 16, further comprising at least one pair of elastic buffer bodies arranged between the movable carrier and the fixed support so as not to interfere with the limited movement of the movable carrier relative to the fixed support parallel to the reference axis on either side of the reference position below a predetermined amplitude threshold and so as to resiliently counteract further movement of the movable carrier relative to the fixed support away from the reference position beyond the predetermined amplitude threshold, each in a respective one of the two opposite directions.

18. A rail vehicle comprising two subassemblies consisting of a vehicle body and a running gear, the rail vehicle further comprising the buffer system of claim 16, wherein the lateral stop means of said one of the first and second stop devices of the buffer system are attached to the running gear and the lateral counter-stop means of the other one of the first and second stop devices are attached to the vehicle body so as to limit the relative movement between the vehicle body and the running gear in a transverse direction of the rail vehicle.

* * * * *